US005634630A

United States Patent [19]

Jung

[11] Patent Number: 5,634,630

[45] Date of Patent: Jun. 3, 1997

[54] STAPLER OPERATING DEVICE WITH A SHEET DISCHARGING MECHANISM FOR A COPY MACHINE

[75] Inventor: Yeon K. Jung, Seoul, Rep. of Korea

[73] Assignee: Sindo Ricoh Co., Ltd., Seoul, Rep. of Korea

[21] Appl. No.: 673,979

[22] Filed: Jul. 1, 1996

[30] Foreign Application Priority Data

Sep. 5, 1995 [KR] Rep. of Korea ..... 1995-29055

[51] Int. Cl.[6] ..... B65H 39/05

[52] U.S. Cl. ..... 270/58.14; 270/32; 270/52.18

[58] Field of Search ..... 270/32, 37, 52.18, 270/58.07, 58.08, 58.14

[56] References Cited

U.S. PATENT DOCUMENTS

| | | | |
|---|---|---|---|
| 4,466,608 | 8/1984 | DuBois et al. . | |
| 4,928,941 | 5/1990 | Uto et al. | 270/58.14 |
| 5,203,550 | 4/1993 | Kawano et al. | 270/58.14 |
| 5,542,655 | 8/1996 | Murakami | 270/58.14 |
| 5,570,875 | 11/1996 | Jung | 270/58.08 |
| 5,573,233 | 11/1996 | Hirai et al. | 270/58.08 |

*Primary Examiner*—John T. Kwon

*Attorney, Agent, or Firm*—Pennie & Edmonds

[57] ABSTRACT

The present invention discloses a stapler operating device with a sheet discharging mechanism in a copy machine. The device includes a sheet discharging mechanism for feeding sheets which has a plurality of trays for accommodating the sheets, each of which has a guide slot for admitting a stapler into it in the horizontal plane, a stapler operating mechanism which has a sector gear arranged in the horizontal plane, on which the stapler is mounted, and a resilient means for forcing the sector gear to draw back to the original position, and a drive part for operating the sheet discharging mechanism and the stapler operating mechanism, which has a stepping motor for producing torque selectively in both positive and negative directions, and an one way clutch for disclutching the torque to the stapler operating mechanism when the motor produces the positive direction torque.

8 Claims, 10 Drawing Sheets

STAPLER OPERATING DEVICE WITH A SHEET DISCHARGING MECHANISM FOR A COPY MACHINE

BACKGROUND OF THE INVENTION

The present invention relates to a stapler operating device with a sheet discharging mechanism for a copy machine, more particularly to a device which operates the sheet discharging mechanism and the stapler operating mechanism by means of a drive, and staples a set of sheets diagonally in the corner of the sheets.

A sorter with stapling function for a copy machine performs sorting, which deposits copied sheets into a tray in respective sequence, and stapling, which staples a set of the sheets.

Nowadays, the demand has increased for compact and power saving copy machines. Also the demand for a copy machine that staples the sheets diagonally in the corner has increased because the diagonally-stapled sheets provide better strength in cohesion than the vertically or horizontally-stapled sheets in the corner thereof.

SUMMARY OF THE INVENTION

The present invention is directed to a stapling operating device that satisfies these demands. A stapler operating device with a sheet discharging mechanism having features of the invention comprises a sheet discharging mechanism for discharging a sheet to each tray, a stapler operating mechanism which operates a stapler to move in a horizontal plane into a stapling position and return the stapler back to its original position after stapling, and a drive part for producing a torque to operate the sheet discharging mechanism and the stapler operating mechanism.

The sheet discharging mechanism includes a plurality of trays for accommodating the sheets and each tray has a guide slot for admitting the stapler into it.

The stapler operating mechanism includes a stapler rotator for rotating the stapler to enter the guide slot in a horizontal plane.

The drive part includes a drive means for producing torque selectively in both positive and negative directions, and a torque clutching means for disclutching the torque to the stapler operating mechanism when the drive means produces the positive direction torque.

Also, the present invention is directed to a stapler operating mechanism with a sheet discharging mechanism comprising a sheet discharging mechanism for discharging a sheet to each tray, a stapler operating mechanism which operates a stapler to move in a horizontal plane into a stapling position and return the stapler back to its original position after stapling, and a drive part for producing a torque operating the sheet discharging mechanism and the stapler operating mechanism.

The drive part includes a drive means which produces the torque selectively in both positive and negative directions, drive torque transmitting means for transmitting the torque to the sheet discharging mechanism and to the stapler operating mechanism, and a torque clutching means for clutching and disclutching the torque transmitting means to the stapler operating mechanism when the torque direction is negative and positive, respectively, whereby the torque flows to the stapler operating mechanism when the torque direction is negative while the sheet discharging mechanism receives the torque regardless of the torque direction.

The sheet discharging mechanism includes a sheet discharging roller; a shaft on which the sheet discharging roller is mounted; a plurality of trays for accommodating the discharged sheet, disposed in a vertical stack with space in between, and adjacent to the discharging roller, each tray having a guide slot for admitting a stapler into it; and a discharging torque receiving means connected with the drive torque transmitting means.

The stapler operating mechanism includes a stapler operating torque receiving means connected to the drive torque transmitting means for receiving the torque; a sector gear, on which the stapler is mounted, arranged in the horizontal plane and connected with the torque receiving means, whereby the stapler enters the receiving slot for stapling as the sector gear rotates to the tray side; a fixing means; and a resilient means placed between the sector gear and the fixing means thereby producing a restoring force when the stapler is rotated away from its original position, as a result, the stapler is return back to its original position when the drive means in the drive part produces the positive direction torque and the torque clutching means disengages.

BRIEF DESCRIPTION OF THE INVENTION

These and other features, aspects, and advantages of the present invention will become better understood with regard to the following description, appended claims, and accompanying drawings where:

Figure 7A:
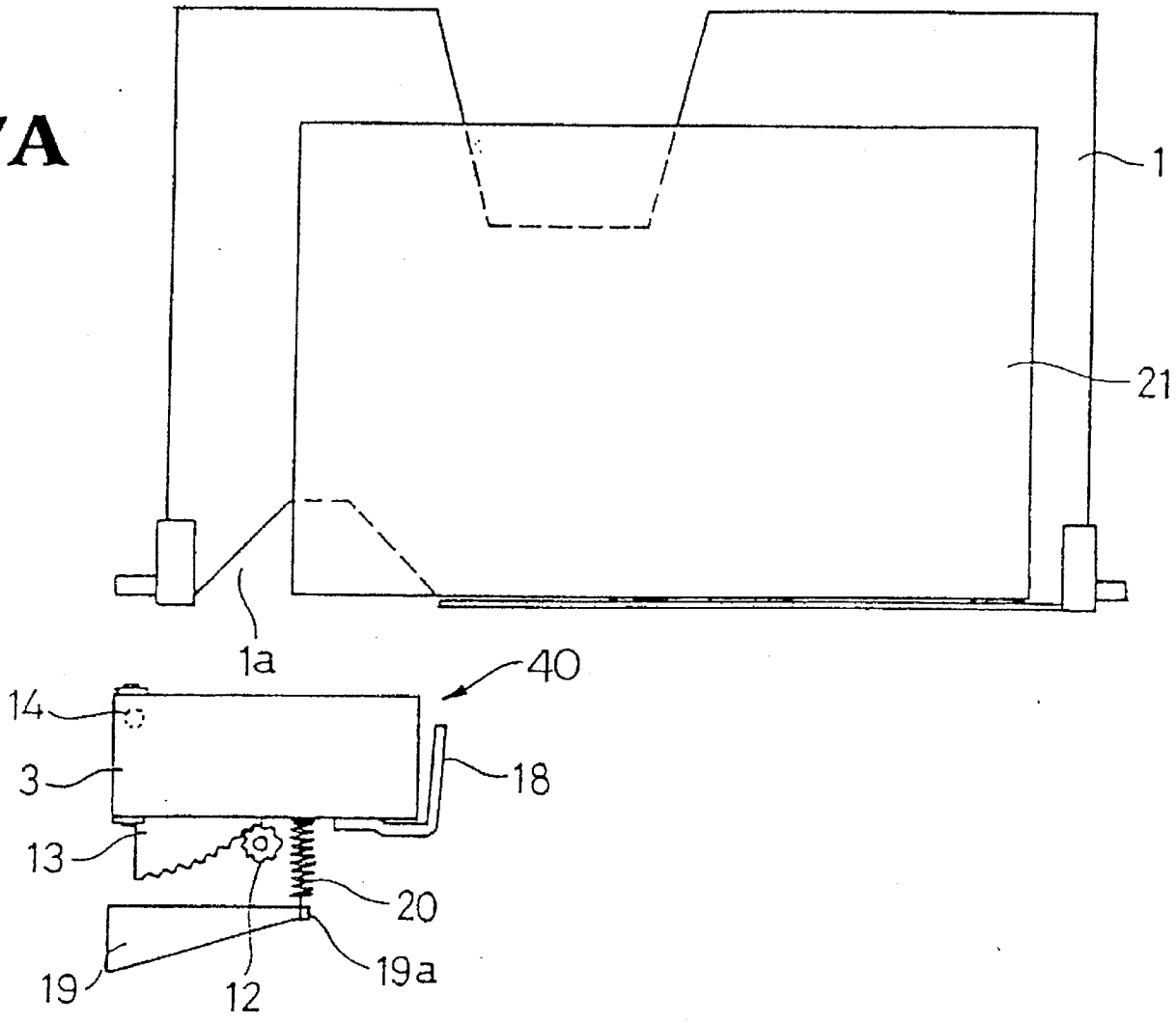
Figure 7B:
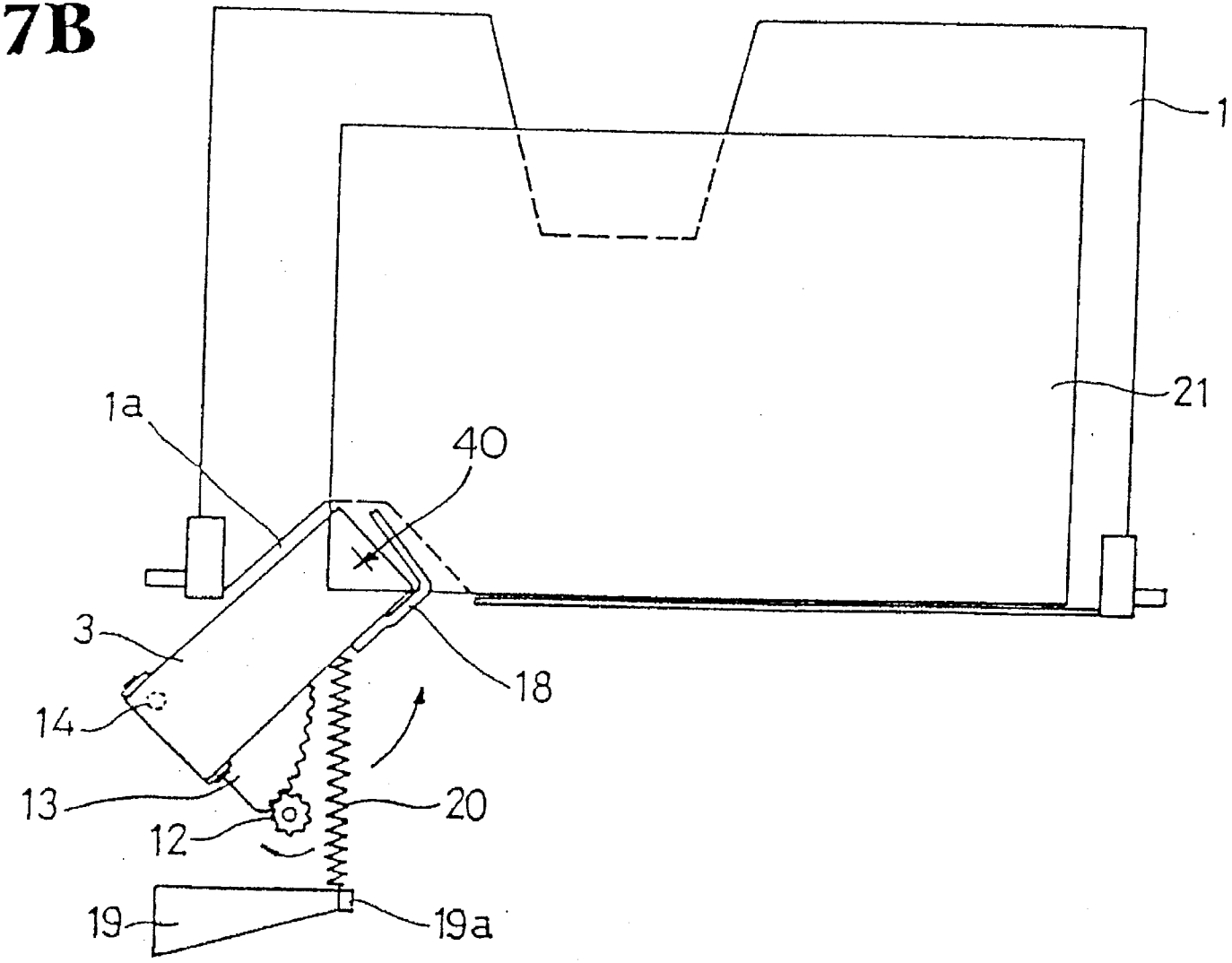
Figure 8A:
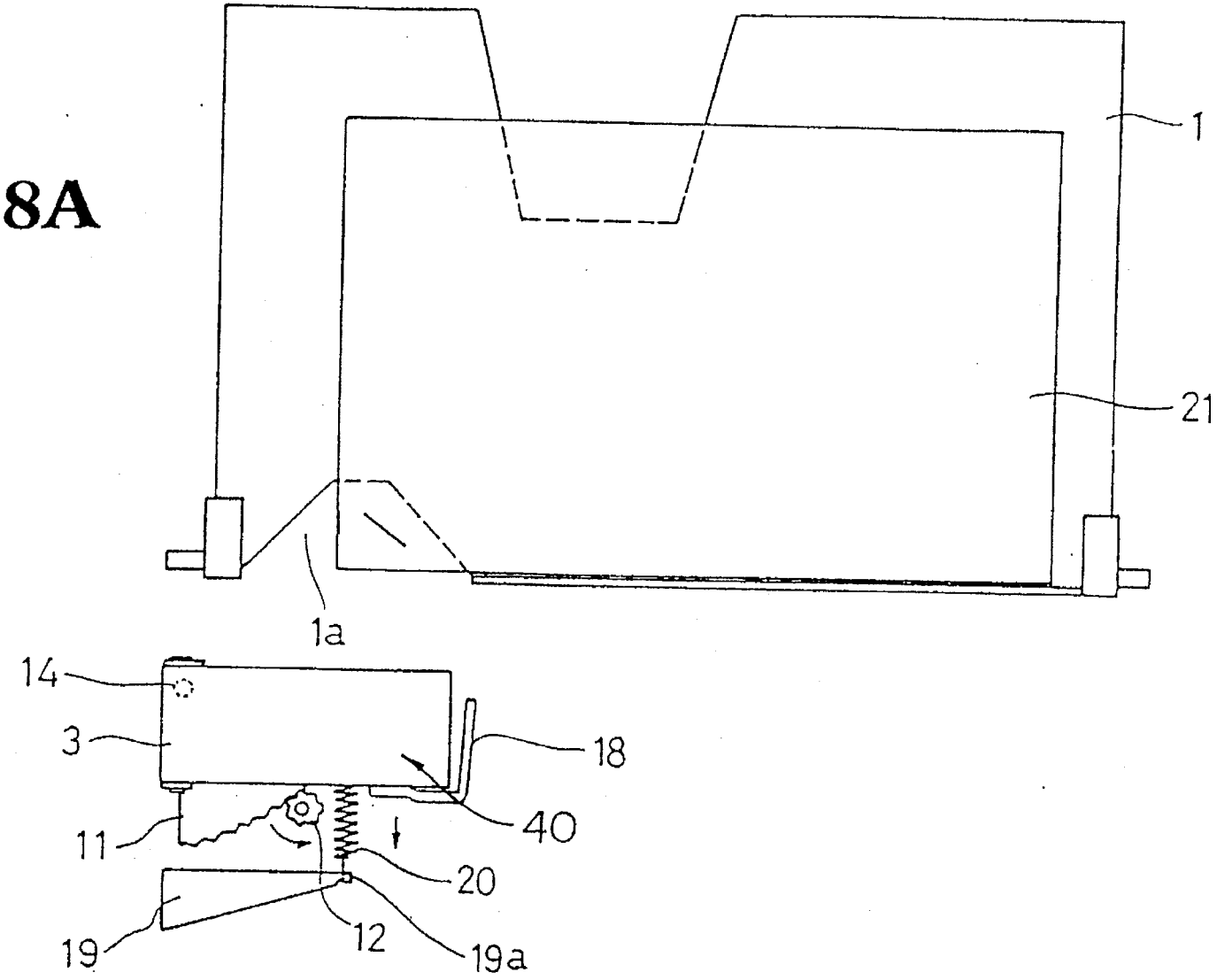
Figure 8B:
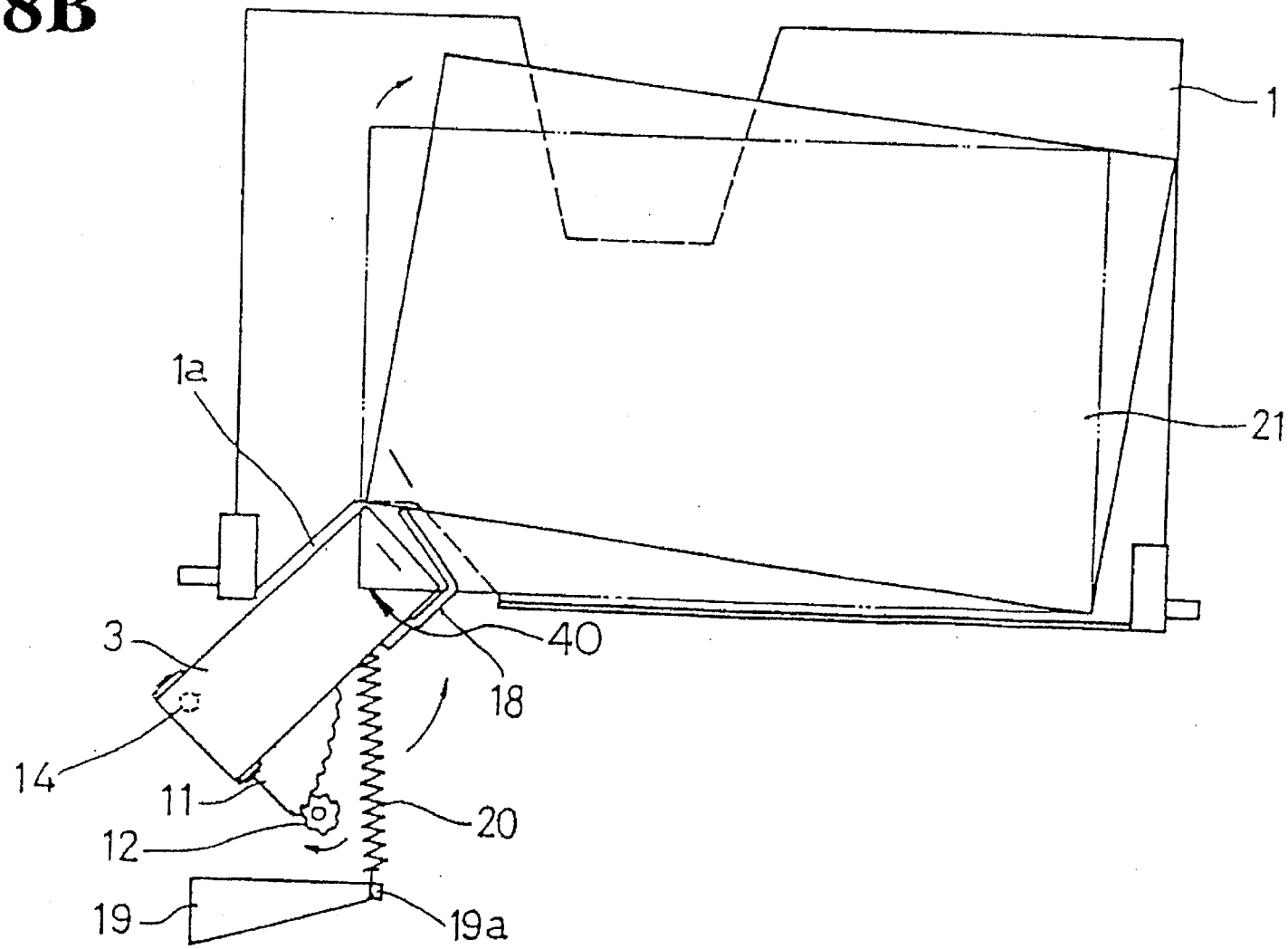

FIGS. 7(A) to 7(B) are views showing the operation of a stapling mechanism for an uppermost tray according to the version of the present invention; and FIGS. 8(A) to 8(B) are views showing the operation of the stapling mechanism for a tray subsequent to the uppermost tray according to the version of the present invention.

DETAILED DESCRIPTION OF THE INVENTION

In this description and following claims, positive direction for the torque produced in the drive means will be used to define the direction which result in feeding sheets in the sheet discharging mechanism, and, also, negative direction for the torque produced in the drive means will be used to define the direction which result in rotating the sector gear or stapler rotator toward the tray side in the stapler operating mechanism, respectively.

Figure 1:
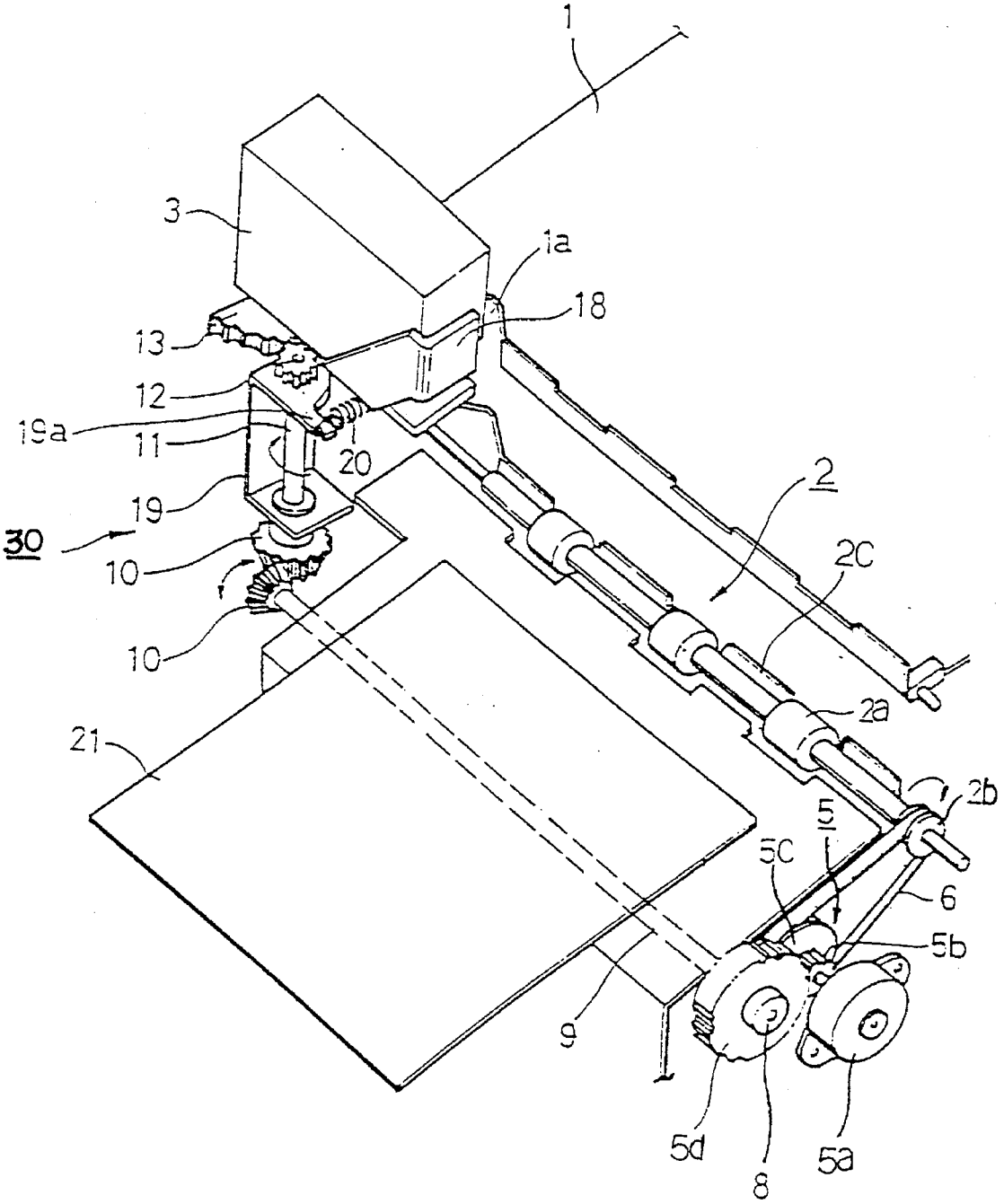
FIG. 1 is a view showing a perspective view of a stapler operating device with a sheet discharging mechanism for a copy machine according to a version of the present invention.

With reference to FIG. 1, positive and negative directions mean clockwise and counter-clockwise directions, respectively, if viewed from the right side of a copy machine when the tray part of the copy machine is placed in the front side.

FIG. 1 shows a perspective view of a stapler operating device with a sheet discharging mechanism for a copy machine according to a version of the present invention.

As shown, the stapler operating device with a sheet discharging mechanism includes a sheet discharging mechanism 2, a drive part 5, and a stapler operating mechanism 30. The sheet discharging mechanism 2 discharges a sheet 21 to a tray 1 and is operated by a torque transmitted from the drive part 5. The drive part 5 provides the torque to operate the stapler operating mechanism as well as the sheet discharging mechanism 2. It includes a drive means 5*a*, and a torque clutching means 8 for clutching or disclutching the torque to the stapler operating mechanism 30. The stapler operating mechanism 30 moves the stapler 3 into the stapling position by using a sector gear 13 operated by the torque transmitted from the drive part 5, and after completing stapling, returns the stapler 3 back to its original position by using a resilient means 20.

In the sheet discharging mechanism 2 of a copy machine, there are a discharging roller 2*a* mounted on a discharging roller shaft 2*c* for discharging the copied sheet, and multiple trays 1 for receiving the discharged sheet 21 therefrom.

The trays 1 are disposed in a vertical stack with space in between and adjacent to the discharging roller 2*a*. Each tray has a guide slot 1*a* for admitting a stapler 3 into it. This sheet discharging mechanism also has a discharging roller pulley 2*b*, mounted on the discharging roller shaft 2*c* at its right end in the view, for receiving the torque from the drive part 5.

The stapler operating mechanism 30 includes the sector gear 13 arranged in a horizontal plane, a stapler operating pinion 12 meshed with the sector gear 13, a bevel gear 10, an intermediate shaft 11 for connecting the pinion 12 with the bevel gear 10 in the vertical direction. The bevel gear 10 is connected with a drive gear 5*d* in the drive part 5 through a parallel shaft 9 so that the stapler operating mechanism 30 can receive the torque from the drive part 5.

Furthermore, there are a bracket 19 which holds the pinion 12, and a stapler unit 40 (refer to FIG. 2 to 5). The bracket 19 includes a protrusion 19*a*, to which one side of the resilient means 20, such as a spring, is attached and the other side of the resilient means 20 is attached to the lower side of the stapler unit 40 (not shown).

The resilient means 20 forces the stapler unit 40 to draw back into its original position after the stapler 3 completes stapling, which will be described in detail hereafter.

The driving part 5, provided on the right side of the discharging mechanism, as shown in this version of the invention, includes the drive means 5*a*, such as a motor, a drive pinion 5*b* connected with the drive means 5*a*, a drive pulley 5*c* attached to the drive pinion 5*b*, and a drive gear 5*d* meshed with the drive pinion 5*b* with which the torque clutching means 8 is provided. A drive means 5*a*, preferably a stepping motor for a precise displacement control, can produces the torque selectively in both positive and negative directions. When the drive means 5*a* produces the torque, it is transmitted to the gear 5*d* through the drive pinion 5*b* and to the drive pulley 5*c*. Accordingly, the gear 5*d* and the drive pulley 5*c* are ready to transmit the torque to the stapler operating mechanism 30 and to the sheet discharging mechanism 2.

However, at this state, the torque clutching means 8, such as one way clutch, freewheels or locks the gear 5*d* depending on the torque direction produced in the drive means 5*a*. In this version of the invention, the torque clutching means 8 freewheels the gear 5*d* in case of the positive direction torque, and locks the gear 5*d* in case of the negative direction torque. As a result, the drive part 5 transmits the torque to the stapler operating mechanism when the drive means 5*a* produces the negative direction torque.

The torque from the drive part 5 flows to the sheet discharging mechanism 2 through a belt 6 connecting the drive pulley 5*c* with the discharging roller pulley 2*b*.

Also, the torque produced in the drive part 5 flows to the stapler operating mechanism 30 through the drive gear 5*d* and the parallel shaft 9 if the torque clutching means 8 locks the drive gear 5*d*. Accordingly, when the torque clutching means 8 is in the clutched direction, that is, the drive means 5*a* produce the torque in negative direction in this version of the present invention, the torque flows from the driving means 5*a* to the sector gear 13 and the sector gear 13 rotates toward the tray side in a horizontal plane. As a result, the stapler unit 40 mounted on the sector gear 13 enters the guide slot 1*a* for performing stapling.

FIGS. 2 to 5 shows the construction of the stapler unit 40 and the operation thereof.

Figure 2:
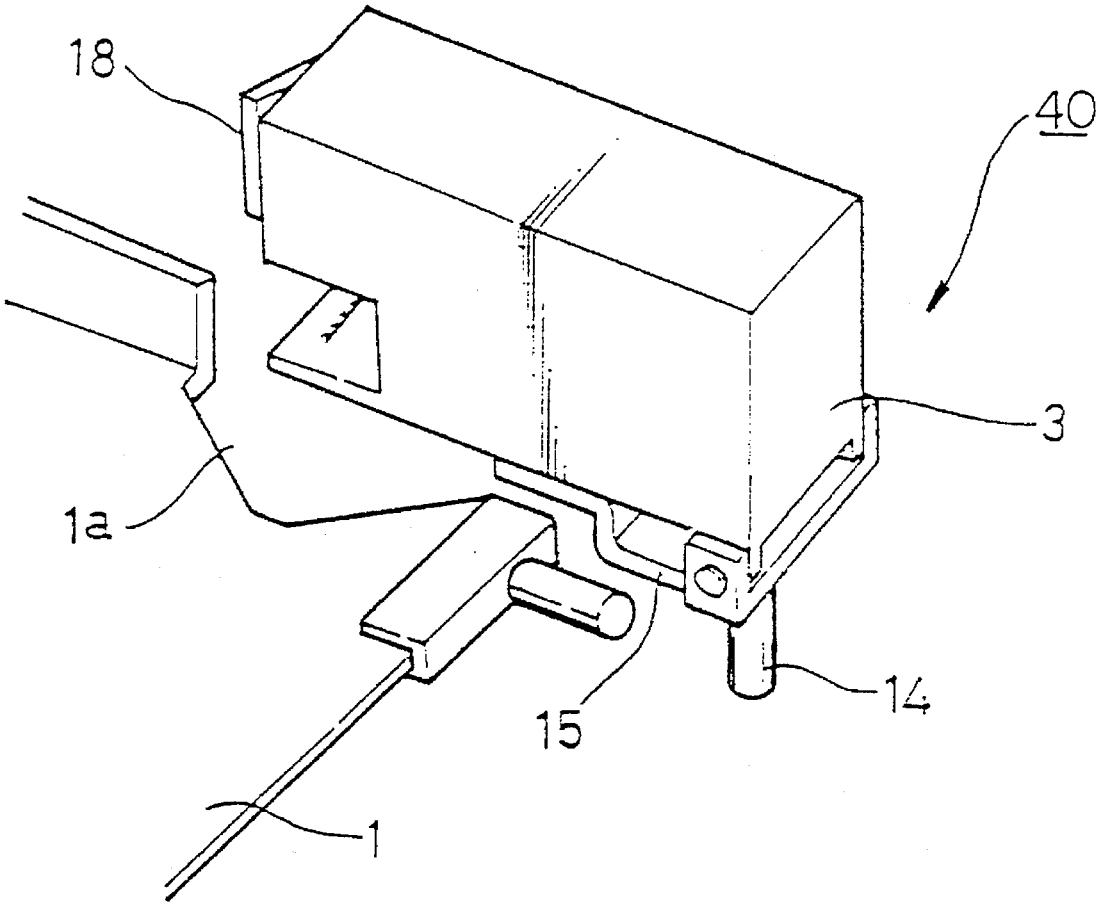
FIG. 2 is a view showing the construction of a stapler unit according to the version of the present invention.
Figure 3:
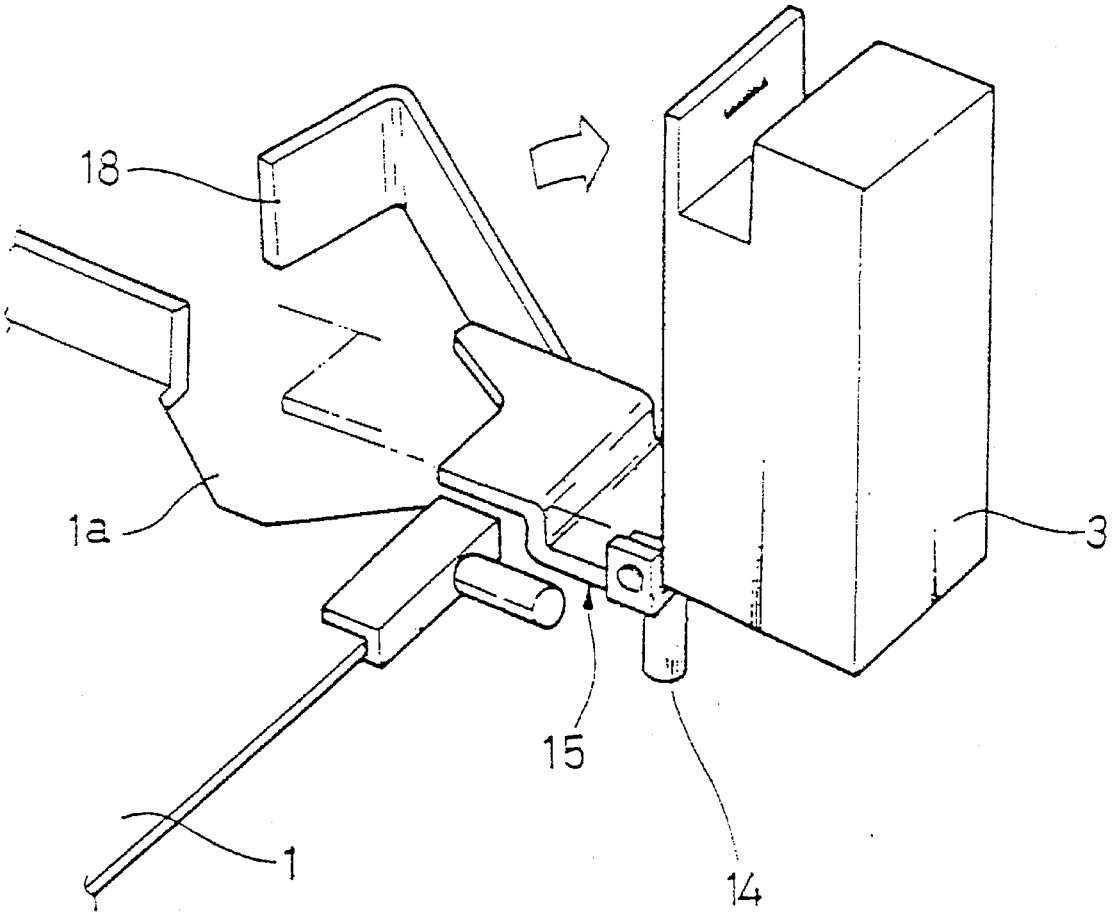
FIG. 3 is a view showing the state in which a stapler is hinged up from the stapler unit according to the version of the present invention.
Figure 4:
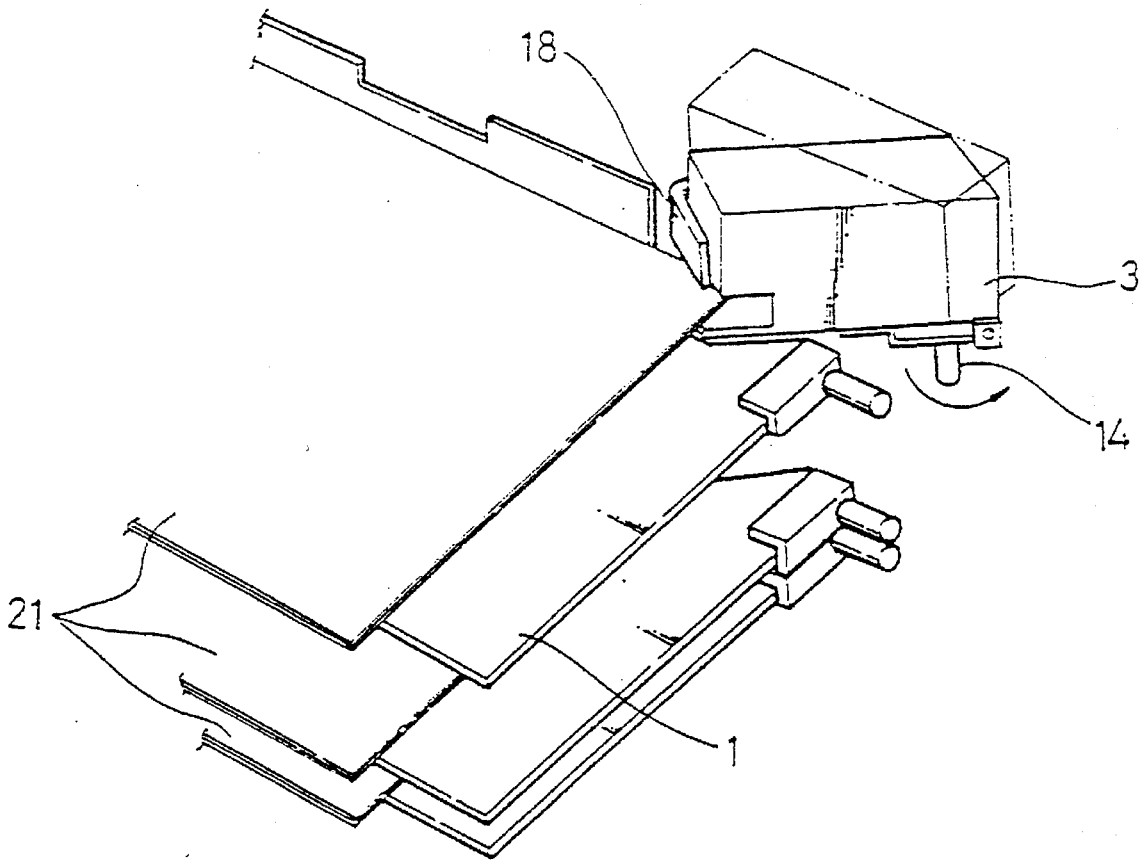
FIG. 4 is a view showing the state in which the stapler in the stapler unit is rotated to the stapling position in diagonal alignment to a set of sheets accommodated in a corresponding tray according to the version of the present invention.
Figure 5:
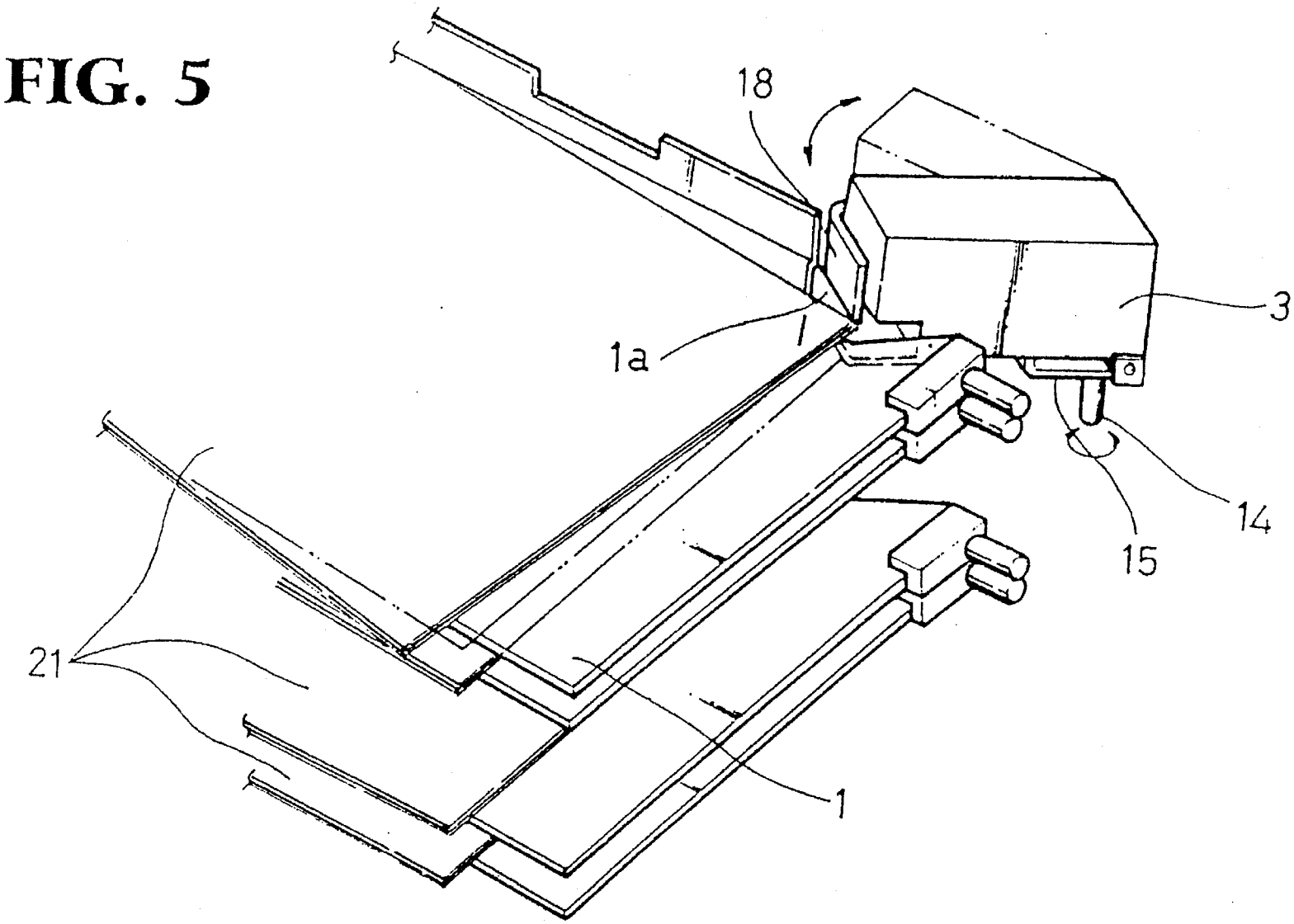
FIG. 5 is a view showing how a picker in the stapler unit works according to the version of the present invention.
Figure 6:
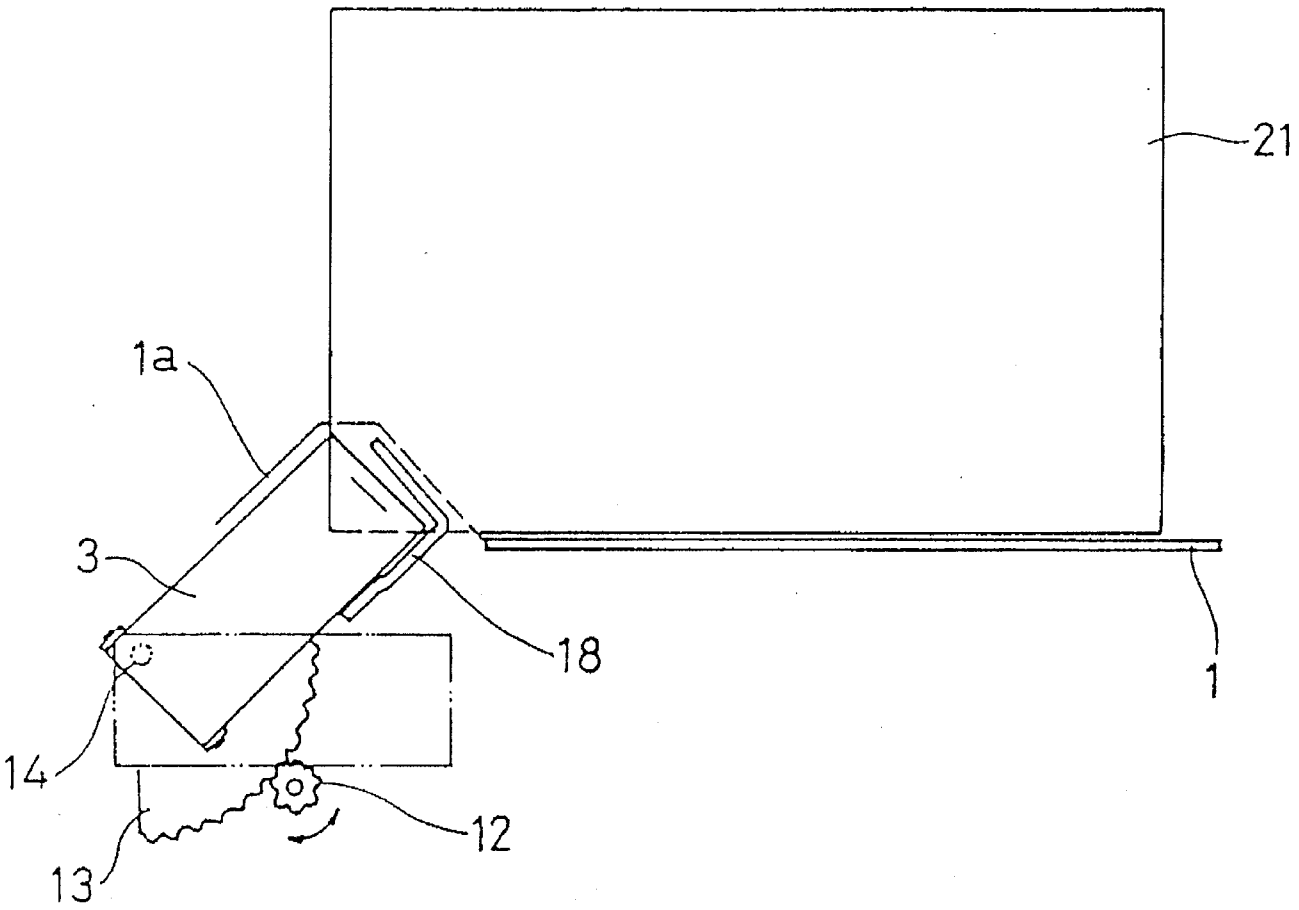
FIG. 6 is a view showing how the stapler unit enters a guide slot as a sector gear rotates according to the revolution of a pinion meshed with the sector gear according to the version of the present invention.

With reference to FIGS. 2 to 3, the stapler unit 40 includes a supporting plate 15, on which the stapler 3 is mounted and to which the stapler 3 is hinged, and a protrusion 14 extending from the lower side of the plate 15. The protrusion 14 is fitted to the hole formed in the sector gear 13 (not shown). Accordingly, the stapler unit 40 is mounted on the sector gear 13 and the stapler 3 can be hinged up, in order to remove jammed paper.

Also, a picker 18 is provided in the supporting plate 15 and configured by extending with upper inclination and bending to the tray side in the upper portion thereof. It is used to push the previously stapled sheets in the tray 1 and secure the space for stapling as the stapler unit 40 enters to the guide slot 1*a*.(refer to FIG. 5).

Now, it will be described how the version of the invention works with reference to FIGS. 1 and 6 through 8.

FIGS. 7(A) to 7(B) show the operation of a stapling mechanism on the an uppermost tray according to the version of the present invention.

Firstly, the drive means 5*a* produces a positive direction torque and the torque is transmitted to the discharging mechanism 2 so that the discharging roller 2*a* rotates to discharge the sheet 21 to the tray 1. In this case, the positive direction torque is not transmitted to the stapler operating mechanism 30 due to the operation of the torque clutching means 8.

After the discharging mechanism has discharged the copied sheets to their respective trays (sorting function), the drive means 5*a* produces a negative direction torque. In this case, the torque clutching means locks the drive gear 5*d* so that the torque flows to the sector gear 13. As a result, the sector gear 13 rotates in a horizontal plane to the tray side and the stapler unit 40 also rotates and enters to the guide slot 1*a* in the tray (refer to FIGS. 6 to 7). When the stapler unit reaches the stapling position, the drive means 5*a* stops, and the stapler 3 obtains a stapling position. Then the stapler 3 staples a set of the sheets accommodated in the uppermost tray. At this state, although the resilient member 20 is tensioned and forces the stapler unit 40 to return back, a holding torque that is needed to operate the drive means 5*a* when it is initiated, prevents the stapler unit 40 from returning back to its original position. After stapling, the drive means 5*a* produces the positive direction torque and the torque clutching means 8 freewheels the drive gear 5*d*. As a result, the restoring force of the resilient member 20 on the stapler unit 40 works to return the stapler unit 40 back to its original position in accordance with the freewheeling rate of the drive gear 5*d*.

As shown in FIGS. 8(A) to 8(B), the picker 18 in the staple unit 40 pushes the previously stapled set of sheets away as the stapler unit 40 enters the guide slot 1*a* of the next tray beneath the uppermost tray so that it is possible to secure the space for stapling without widening the space defined between the trays.

As described above, by the present invention, it is possible to provide a compact and power saving stapler operating device with sheet discharging mechanism in a copy machine because it uses one driving means to operate both a sheet discharging mechanism and a stapling mechanism. Furthermore, it is possible to staple sheets diagonally in the corner of the sheet accommodated in a tray, because a stapler enters a guide slot of the tray in a horizontal plane as it rotates. Moreover, by the work of a picker provided in a stapler unit, this stapling device with sheet discharging mechanism according to the present invention performs stapling without widening the space formed between the trays for securing the sufficient space to receive the stapler.

Many advantages of the present invention are not all included in the description and many versions of the present invention will be possible according to the appended claims.

What is claimed is:

1. A stapler operating device with a sheet-discharging mechanism in a copy machine comprising:

a sheet discharging mechanism for discharging a sheet to each tray; a stapler operating mechanism which operates a stapler to move in a horizontal plane into a stapling position and return the stapler back to its original position after stapling; and a drive part for operating the sheet discharging mechanism and the stapler operating mechanism, wherein:

the drive part includes a drive means which produces the torque selectively in both positive and negative directions; drive torque transmitting means for transmitting the torque to the sheet discharging mechanism and the stapler operating mechanism; and torque clutching means for clutching and disclutching the torque transmitting means to the stapler operating mechanism when the torque direction is negative and positive, whereby the torque flows to the stapler operating mechanism when the torque direction is negative;

the sheet discharging mechanism includes a sheet discharging roller, a shaft on which the sheet discharging roller is mounted; a plurality of trays for accommodating the discharged sheet disposed in a vertical stack with space in between and adjacent to the discharging roller, each tray having a guide slot for admitting the stapler into it; and a discharging torque receiving means connected with the drive torque transmitting means; and the stapler operating mechanism includes a stapler operating torque receiving means connected with the drive torque transmitting means; a sector gear, on which the stapler is mounted, arranged in a horizontal plane and connected with the torque receiving means, whereby the stapler enters the guide slot for stapling as the sector gear rotates to the tray side when the drive means produces a negative direction torque; a fixing means; and a resilient means placed between the sector gear and the fixing means thereby producing a restoring force when the stapler is rotated away from the original position so that the stapler is returned back to its original position when the drive means in the drive part produces the positive direction torque and the torque clutching means disengages.

2. A stapler operating device with a sheet discharging mechanism as set forth in claim 1, wherein the drive torque transmitting means includes a drive pinion connected with the drive means, a drive pulley attached to the drive pinion, and a drive gear meshed with the drive pinion and provided with the torque clutching means; and the discharging torque receiving means is a pulley mounted on the discharging roller shaft and connected with the drive pulley by a belt.

3. A stapler operating device with a sheet discharging mechanism as set forth in claim 2, wherein the stapler operating torque receiving means includes a stapler operating pinion meshed with the sector gear, a bevel gear, an intermediate shaft for connecting the stapler operating pinion with the bevel gear in the vertical direction, and a parallel shaft connecting the bevel gear with the drive gear.

4. A stapler operating device with a sheet discharging mechanism as set forth in claim 1, further comprising a stapler unit mounted on the sector gear, the stapler unit including a supporting plate for supporting the stapler, to which the stapler is hinged at its one end; and a picker provided in the supporting plate, and having a configuration extending with upward inclination and bending the tray side in the upper portion thereof, whereby it pushes out the previously stapled sheets in the tray when the stapler unit enters the guide slot as the sector gear rotates.

5. A stapler operating device with a sheet discharging mechanism as set forth in claim 4, wherein the fixing means is a bracket having a protrusion to which one side of the resilient means is attached and the other side of the resilient means is attached to the lower side of the stapler unit.

6. A stapler operating device with a sheet discharging mechanism as in claims 1, 2, 3, 4, or 5, in which the drive means in the drive part is a stepping motor and the torque clutching means is an one way clutch.

7. A stapler operating device with a sheet discharging mechanism in a copy machine, the device comprising:

a sheet discharging mechanism for discharging a sheet to each tray; a stapler operating mechanism which operates a stapler to move in a horizontal plane into a stapling position and return the stapler back to its original position after stapling; and a drive part for operating the sheet discharging mechanism and the stapler operating mechanism, wherein:

the drive part includes a drive means for producing torque selectively in both positive and negative directions, and a torque clutching means for disclutching and clutching the torque to the stapler operating mechanism when the drive means produces the positive and negative direction torques;

the sheet discharging mechanism includes a plurality of trays for accommodating the sheets, each of which has a guide slot for admitting a stapler into it in the horizontal plane; and the stapler operating mechanism includes a stapler rotator for rotating the stapler to enter the guide slot in a horizontal plane by receiving the torque from the drive part, and a resilient means for forcing the stapler rotator to draw back to its original position when the stapler rotator is rotated toward the tray side, whereby the stapler rotator returns back to its original position when the torque is disclutched by the torque clutching means.

8. A stapler operating device with a sheet discharging mechanism as set forth in claim 7, in which the drive means in the drive part is a stepping motor and the torque clutching means is an one way clutch.

* * * * *